US006418832B1

(12) United States Patent
Colvin

(10) Patent No.: US 6,418,832 B1
(45) Date of Patent: Jul. 16, 2002

(54) BODY ARMOR

(75) Inventor: David P. Colvin, Cary, NC (US)

(73) Assignee: Pyramid Technologies International, Inc., Cary, NC (US)

( * ) Notice: Subject to any disclaimer, the term of this patent is extended or adjusted under 35 U.S.C. 154(b) by 0 days.

(21) Appl. No.: 09/558,496

(22) Filed: Apr. 26, 2000

(51) Int. Cl.[7] ..... F41H 5/04
(52) U.S. Cl. ..... 89/36.02; 89/36.05; 2/2.5
(58) Field of Search ..... 89/36.05, 36.02; 2/2.5

(56) References Cited

U.S. PATENT DOCUMENTS

| | | | | | |
|---|---|---|---|---|---|
| 4,905,320 | A | * | 3/1990 | Squyers, Jr. | 2/2.5 |
| 4,965,138 | A | * | 10/1990 | Gonzalez | 89/36.08 |
| 5,317,950 | A | * | 6/1994 | Binon et al. | 89/36.02 |
| 5,349,893 | A | * | 9/1994 | Dunn | 89/36.05 |
| 5,435,226 | A | * | 7/1995 | McQuilkin | 89/36.02 |
| 5,654,518 | A | * | 8/1997 | Dobbs | 89/36.02 |
| 5,918,309 | A | * | 7/1999 | Bachner, Jr. | 2/2.5 |

FOREIGN PATENT DOCUMENTS

| | | | | |
|---|---|---|---|---|
| DE | 4125918 | * | 2/1992 | 89/36.02 |

* cited by examiner

*Primary Examiner*—Stephen M. Johnson
(74) *Attorney, Agent, or Firm*—Robert G. Rosenthal

(57) ABSTRACT

A body armor system having improved impact energy absorbing characteristics includes a projectile penetrant inhibiting layer and an impact energy absorbing layer positioned in overlying relation to one side of the projectile penetrant inhibiting layer such that the impact energy absorbing layer is adapted to absorb the impact energy from an incoming projectile. The impact energy absorbing layer spreads at least a portion of the impact energy in the plane of the impact energy absorbing layer. An anti-spalling layer is positioned on the opposite side of the projectile impact inhibiting layer. In another aspect of the invention, the impact energy absorbing layer contains a foam to further enhance impact energy absorption. Additionally, a temperature stabilizing means such as a phase change material is placed within the impact energy absorbing layer and provides thermal regulation. The phase change material may be bulk, microencapsulated or macroencapsulated and may be placed directly within the impact energy absorbing layer or within the foam as desired.

19 Claims, 4 Drawing Sheets

BODY ARMOR

GOVERNMENT RIGHTS

This invention was supported by SOCOM SBIR Contract No. USZA22-98-P.006. The Government has certain rights in this invention.

FIELD OF THE INVENTION

This invention relates generally to the field of protective armor and more particularly to body armor having improved protection against blunt injury trauma.

BACKGROUND OF THE INVENTION

Body armor has been known and used to protect personnel and equipment from projectiles for centuries. Ideally, body armor should prevent injury from ballistic threats including round fragmentation or "spalling" upon striking the armor, penetration of the armor by the projectile and blunt injury trauma to the user beneath the armor.

In connection with the foregoing, armor has traditionally taken the form of a metal plate that was designed to prevent penetration. In the last 20 years significant improvements have been made in body armor as the result of the development of advanced materials. For example, Kevlar® has enabled the construction of bullet-proof vests that are significantly lighter and more flexible than the metal plates previously employed. The so-called "bullet-proof vest" more fully covers the body and may also cover a portion of the extremities. Also, the more comfortable the armor is, the greater the likelihood that it will be worn. Notwithstanding the foregoing, personnel wearing body armor tend to get hot, especially in warmer climates, and they are often removed or not worn at all.

With regard to spalling, it can often be as deadly as round penetration. Upon striking a target, round or projectile fragments can fan out in a 360° pattern normal to the exterior surface of the armor resulting in lethal injuries to the head and neck. In response to this threat, anti-spalling materials have been developed and usually take the form of a layer that is placed external to the body armor. One such material is a flexible rubberized layer available from THETA Technologies of Palm Bay, Fla. and which contains Allied Signal Kevlar® fibers. Another anti-spalling material is a coated, rigid foamed metal such as aluminum which available from ERG, Inc.

Lastly, blunt injury trauma can be almost as incapacitating as round penetration. While the body armor may prevent the penetration of a round, the resulting impact and body trauma can fracture the sternum or ribs, and render the wearer unconscious. Attempts have been made to mitigate the effects of blunt injury trauma, but the materials are heavy and bulky, so they have not been widely adopted.

It is, therefore, an object of the present invention to provide an improved body armor.

It is another object of the present invention to provide an improved body armor which is effective in mitigating blunt injury trauma.

It is yet another object of the present invention to provide an improved body armor that is relatively inexpensive.

It is a further object of the present invention to provide an improved body armor that maintains the wearer cooler than prior art armor.

It is a still further object of the present invention to provide an improved body armor that may be used in conjunction with currently available body armor.

SUMMARY OF THE INVENTION

In accordance with the present invention, there is provided a body armor (or armor generally) comprising a projectile penetrant inhibiting layer and an impact energy absorbing layer positioned in overlying relation to one side of the projectile penetrant inhibiting layer such that the impact energy absorbing layer is adapted to absorb the impact energy from an incoming projectile. More specifically, the impact energy absorbing layer spreads at least a portion of the impact energy in the plane of the impact energy absorbing layer.

In another aspect of the invention, the impact energy absorbing layer contains a foam to further enhance impact energy absorption. Additionally, a temperature stabilizing means such as a phase change material is placed within the impact energy absorbing layer and provides thermal regulation. The phase change material may be bulk, microencapsulated or macroencapsulated and may be placed directly within the impact energy absorbing layer or within the foam as desired.

BRIEF DESCRIPTION OF THE DRAWINGS

Some of the objects of the invention having been stated, other objects will appear as the description proceeds when taken in connection with the accompanying drawings in which.

DETAILED DESCRIPTION OF THE PREFERRED EMBODIMENTS

While the present invention will be described more fully hereinafter, it is to be understood at the outset that persons of skill in the art may modify the invention herein described while still achieving the favorable results of this invention.

Accordingly, the description which follows is to be understood as being a broad teaching disclosure directed to persons of skill in the appropriate arts, and not as limiting upon the present invention.

Figure 1A:
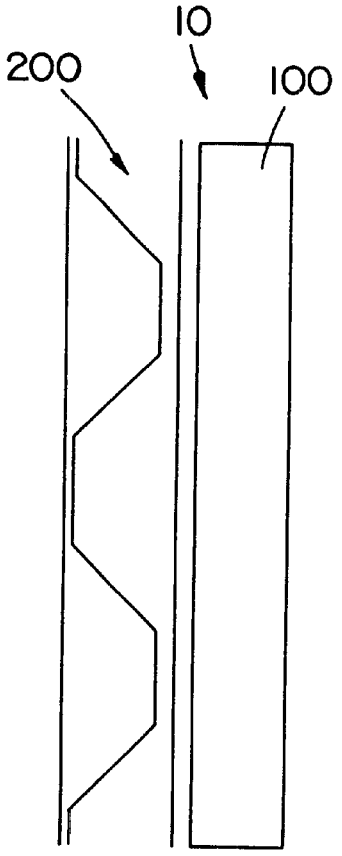
FIG. 1A is a side view of the armor according to this invention.

Referring now to the drawings and particularly to FIG. 1, the body armor of present invention, generally indicated at 10, comprises a projectile penetrant inhibiting layer 100, an impact energy absorbing layer 200. In another embodiment of the invention, an anti-spalling layer 300 is included.

The projectile penetrant inhibiting layer 100 must be a layer that both spreads or broadens the area of impact, and absorbs the greater portion of the round's kinetic energy. Penetration may be prevented by any of the well-known materials such as Spectra Shield from Allied Signal, lightweight hardened titanium plates or ceramic armor from Leading Edge Composites. The foregoing materials most commonly take the form of torso protecting vests made from an appropriate number of layers to stop the expected projectile.

Figure 1B:
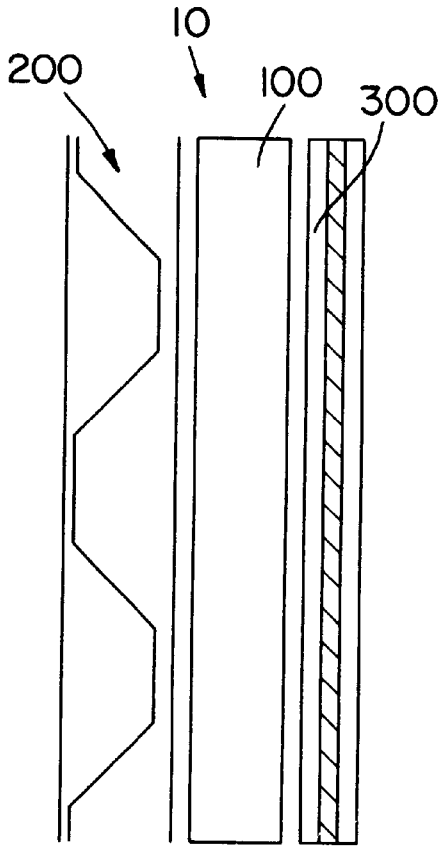
FIG. 1B is a side view of an alternate embodiment of the armor according to this invention.

With respect to spalling, round fragmentation is normally addressed using either a flexible rubberized layer which was developed by THETA Technologies using Allied Signal fibers or a coated, rigid foamed metal (which also provides some high-energy absorption). The THETA material comprises multiple layers of Allied Signal Fibers Spectra Shield embedded in a proprietary rubberized compound that is positioned in front of a metal or ceramic plate to catch fragmented or spalled round fragments. The anti-spalling layer should be flexible, relatively lightweight and can be varied to meet different requirements. The lightweight foamed metal plate was developed to provide a multi-directional inelastic or crushable deformation. The anti-spalling layer 300 is positioned on the opposite side of the projectile penetrant inhibiting layer 100 and is in overlying relation to the said projectile penetrant inhibiting layer as best shown in FIG. 1B.

Figure 3:
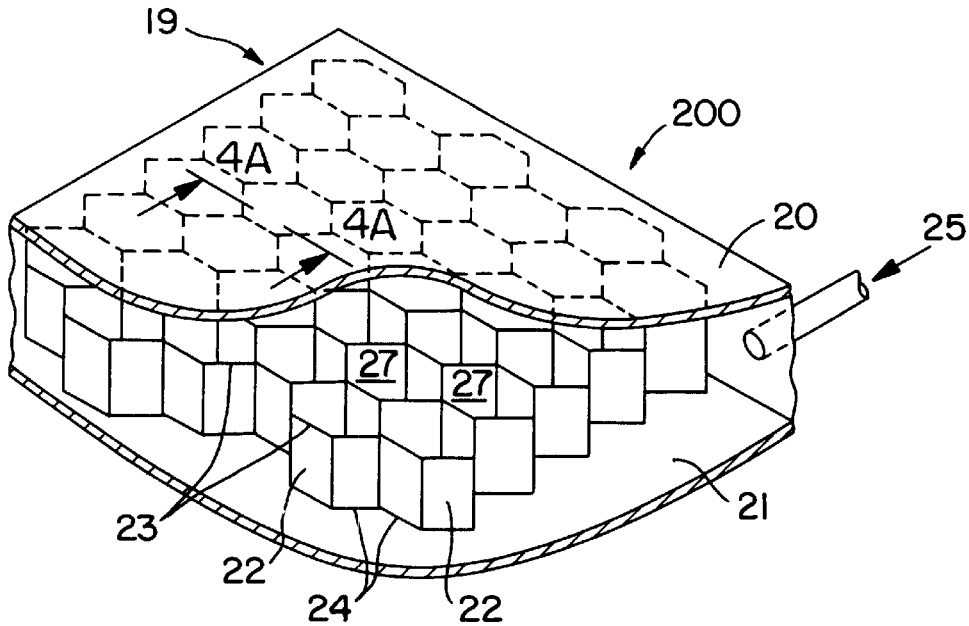
FIG. 3 is a partial schematic sectional perspective view of another embodiment of the impact energy absorbing layer of this invention.
Figure 4A:
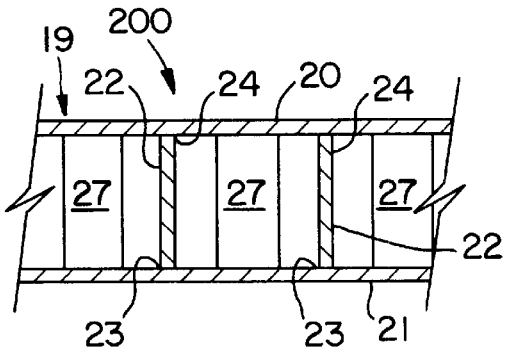
FIG. 4A is a partial elevational section view of the impact energy absorbing layer taken on the line 4A–4A of FIG. 3.

Lastly, an impact energy absorbing layer 200 is positioned proximate and in substantial overlying relation behind the projectile inhibiting layer (when taken in the direction of projectile travel) such that the impact energy absorbing layer absorbs and spreads the impact energy in the plane of the impact energy absorbing layer. The impact energy absorbing layer spreads out the impact loading over a wider surface area, thus slowing the response time of the event, and more closely matching the impedance coupling of the projectile penetrant inhibiting layer and the body of the wearer. One such layer is disclosed in U.S. Pat. Nos. 5,030,501 and 5,518,802 titled Cushioning Structure which is incorporated herein by reference. The impact energy absorbing layer comprises a plurality of cells 76 which are in fluid communication with each other to provide a valved fluid transfer between cells. As shown in FIGS. 3 and 4A, the cell members 22 are of hexagonal shape in cross-sectional plan. In the finally assembled condition the edges 23 of the individual hexagonal cells 22 are bonded to the top stratum 20 and bottom stratum 21 at edges 23 and 24 at one side and at edges 24 at the opposite side, respectively. The bond formed at the edges 23 and 24 is a substantially hermetically sealed connection so that in the assembled condition the matrix includes a plurality of generally hexagonal cells 27 separately sealed one from the next, except as specifically otherwise provided and as hereafter defined.

Since the materials are heat sealable the various seals described herein may be accomplished by conventional heat sealing means. Adhesive could also be used.

The structure 19 is hermetically closed at the periphery and an inlet 25 is provided for the admission of a fluid such as air or other gas which may be at a pressure above surrounding atmosphere or environment in which the structure is placed. The structure 19 is constructed of generally pliable materials, usually plastics, including vinyl and/or polyethylene type films.

Dimensionally it is conceived that the structure 19 could be between about one (1) and thirty (30) centimeters "thick", i.e., the distance from the outside of one stratum to the other, depending upon application. The thickness of the sheet materials from which the strata 20 and 21 and matrix cells wall elements 22 are formed may be between about 0.01 and 100 mills.

Figure 2:
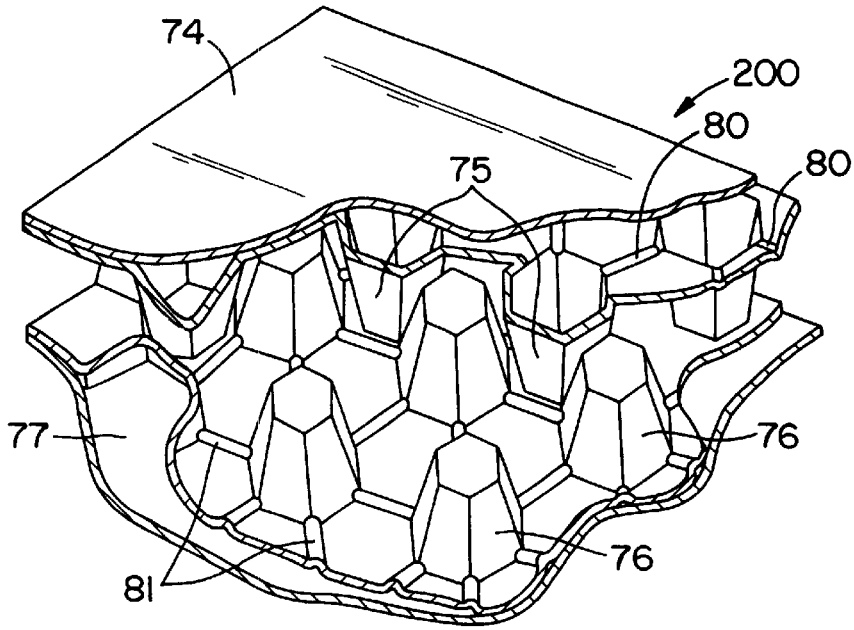
FIG. 2 is a partial schematic sectional perspective view of a portion of the structure of impact energy absorbing layer.
Figure 4B:
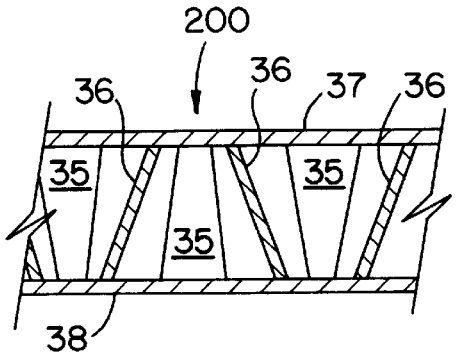
FIG. 4B is a partial elevational section view of another embodiment of the impact energy absorbing layer taken from the same position as FIG. 4A.

In the embodiment shown in FIGS. 2 and 4B the matrix cells comprise hexagonal polygons. Such shape has been chosen because of the unique form of hexagon that permits complete nesting of the vertical surfaces of the cell one to the next. Nevertheless, other forms of polygons may provide the advantages of this invention and are to be considered as within the concepts worthy of further evaluation and usefulness in the application of the principles that are embodied in the structure 19.

For instance, the contacting wall between polygons may be sloped rather than vertical providing tapered or truncated polygons, rather than rectangular polygons as shown in FIG. 2. FIG. 4B shows tapered polygons as an example. In this embodiment a plurality of cells 35 have substantially upstanding sides 36 bonded to an upper planar sheet like stratum 37 and a similar lower stratum 38.

Four sided polygons or cubes are representative of another polygon configuration that may be useful in some circumstances, as seen 5A and 5B.

In this embodiment a plurality of cells 40 are cube-like rectangles, formed or molded into an internal core member 41. Core member 41 is bonded to an upper sheet 42 and a lower sheet 43 at positions of contact 44.

Still other forms of polygons are within ready conception, for instance, pentagons or cones.

Figure 6A:
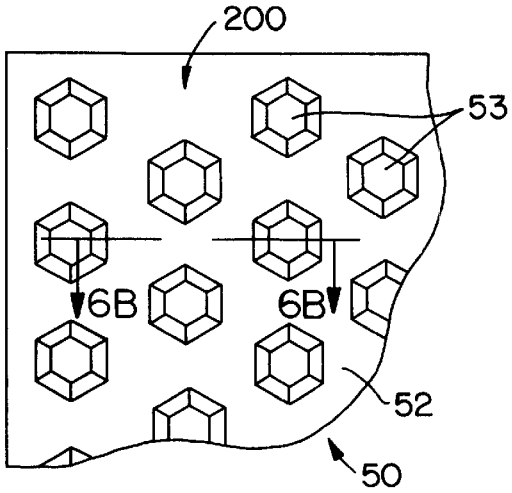
FIG. 6A is a partial plan view of another embodiment of the impact energy absorbing layer of this invention.
Figure 6B:
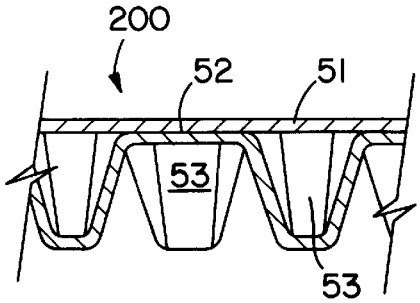
FIG. 6B is a partial elevational section view taken on the line 6B—6B of FIG. 6A

Referring to FIGS. 6A and 6B a structure 50 includes an upper stratum 51 to which is bonded a lower cellular matrix 52 on which is formed a plurality of downstanding/upstanding truncated polygon cells 53 selectively arranged in mutually supporting and equally load distributing relationship across the surface of the stratum 51.

Figure 7:
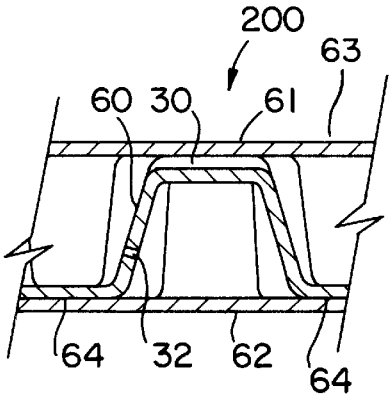
FIG. 7 is a sectional elevation view of another embodiment of the impact energy absorbing layer of this invention.
Figure 8:
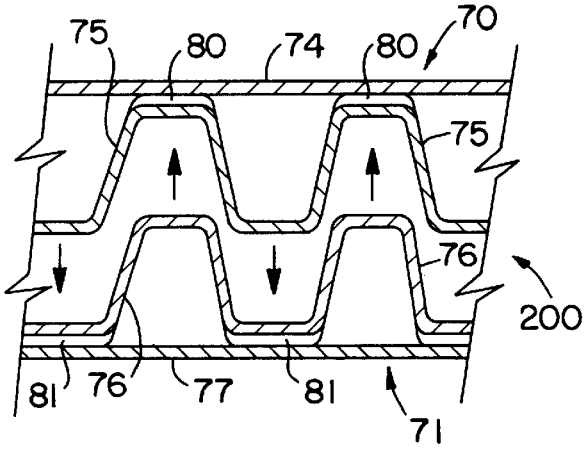
FIG. 8 is a partial elevational section view of another embodiment of the impact energy absorbing layer of this invention.

In another aspect of this invention as shown in FIG. 7, a passage way conduit or aperture 30 is provided from a polygon to each of the adjacent cells through which the fluid is conducted to pass from one cell to the next. By the proper selection of the size of such conduits, the rate of fluid flow may be controlled and serve to "valve" the rate of the fluid passage from one cell to the next. Such conduits 30 may be provided by allowing unbonded areas between the end of a cell 60 and the stratum 61. This controlled venting of the compressed air spring within the impacted cell serves to maximize the absorption of the impact energy while minimizing the energy available for rebound. The difference in pressure between the impacted and the unimpacted, adjacent cells aids the controlled reinflation of the impacted cell in order to provide protection from repeated impacts.

In the embodiment of FIG. 7, an internal matrix structure 60 is sandwiched between an upper stratum 61 and a lower stratum 62 and bonded there between at the surfaces 63 and 64.

Referring to FIG. 7, the internal matrix structure 61 is provided with substantially upstanding walls that may also be designed to provide a one-way valve-like aperture 32 between the walls of the two mating hexagonal structures that aids the reduction of rebound energy. The apertures 32 open upon an impact due to the columnar buckling of the cell walls and pass fluid from the impacted area to adjacent areas when the pressure on the one side increases to a valve higher than the pressure on the other side. When the pressure equalizes during the structural rebound, the resilience of the material in the member 61 causes the valved opening to close or partially close thereby restricting the reverse flow by allowing the pressure to gradually equalize.

Figure 5A:
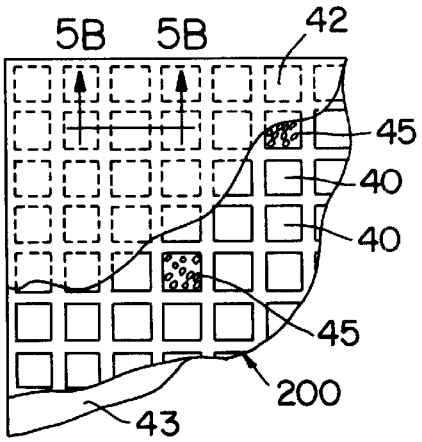
FIG. 5A is a partial schematic sectional plan view of a portion of another embodiment of the impact energy absorbing layer of this invention.
Figure 5B:
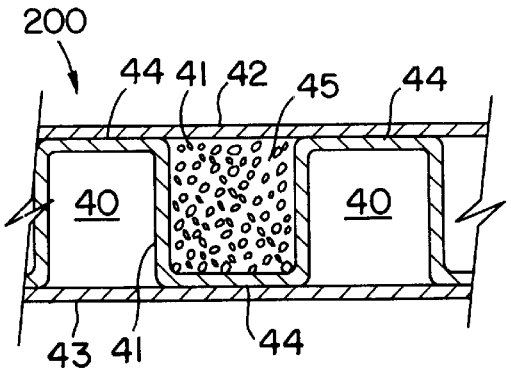
FIG. 5B is a partial elevational section view of a portion of the structure taken on line 5B—5B of FIG. 5A.

Referring again to FIGS. 5A and 5B, in still another aspect of the invention, selected numbers and positioned cells are filled with foam type materials 45 to provide a further parameter of dampening attenuation and energy absorption reaction to the impact energy as well as the restoration or recovery of the cushioning structure to its original or pre-impacted state.

Figure 9:
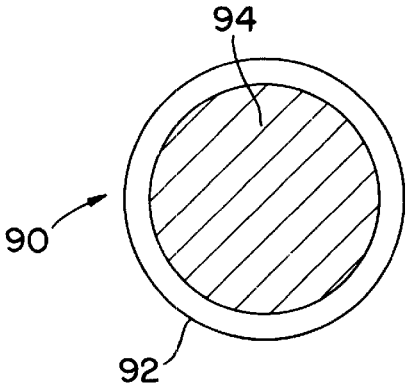
FIG. 9 is a cross sectional view of a micro/macro capsule a employed in this invention.

In another aspect of the invention, a temperature stabilizing means 41 such as a phase change material is incorporated into the foam or could be inserted directly into selected ones of the cells. The temperature stabilizing means 41 acts to maintain the wearer of the body armor cool through the action of the melting of the phase change material. The phase change material may be microencapsulated (capsule diameter under 1.00 mm) or macroencapsulated (capsule diameter over 1.00 mm), depending upon application. A macro or micro capsule 90 is illustrated in FIG. 9 and comprises an outer wall 92 and a phase change material filling 94. A number of phase change materials which have a cooling effect are available, but the paraffinic hydrocarbons are preferred since they are non-toxic, relatively inexpensive and can be contained within plastic films. The table below lists a number of bulk paraffinic compounds whose number of carbon atoms dictate where the material will change phase.

| COMPOUND NAME | NUMBER OF CARBON ATOMS | MELTING POINT DEGREES CENTIGRADE |
|---|---|---|
| n-Octacosane | 28 | 64.1 |
| n-Heptacosane | 27 | 59.0 |
| n-Hexacosane | 26 | 56.4 |
| n-Pentacosane | 25 | 53.7 |
| n-Tetracosane | 24 | 50.9 |
| n-Tricosane | 23 | 47.6 |
| n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |

Each of the materials above is most effective near the melting point indicated above. It will be seen from the foregoing, that the effective temperature range of the body armor can be tailored to a specific environment by selecting the phase change material(s) required for the corresponding temperatures and placing the phase change material therein.

In operation, the user would wear the body armor (or the armor would be placed over the surface to be protected) for as long as protection were required. If the armor contained temperature stabilizing means, the armor would cool the wearer until such time as the thermal capacitor were discharged. Upon the impact of a projectile, the round first impacts the rigid anti-spalling surface and then the anti-penetration layer. The round then flattens and breaks apart, wherein the anti-spalling layer acts to absorb the round fragments. Lastly, the cushioning layer acts to absorb the impact energy to minimize the effects of blunt injury trauma.

It is herein understood that although the present invention has been specifically disclosed with the preferred embodiments and examples, modifications and variations are considered to be within the scope of the invention and the appended claims.

That which is claimed is:

1. An armor system adapted to minimize damage to underlying structures as the result of projectile impact, and comprising:

a projectile penetrant inhibiting layer; and an impact energy absorbing layer positioned proximate and in substantial overlying relation to one side of said projectile penetrant inhibiting layer and wherein said impact energy absorbing layer is adapted to spread the impact energy of the projectile substantially in the plane of the impact energy absorbing layer; and wherein said impact energy absorbing layer comprises a plurality of cells of pliable material which are in fluid communication with each other to provide a valved fluid transfer between cells;

whereby the amount of impact energy passing through the armor system is reduced.

2. The armor system according to claim 1 further including an anti-spalling layer positioned on the opposite side of said projectile penetrant inhibiting layer and wherein said anti-spalling layer is in contact with said impact energy absorbing layer.

3. The armor system according to claim 1 wherein the impact energy absorbing layer comprises:

a. a plurality of planar strata of pliable material having a plurality of cell structures bonded and sealed between the strata with each cell structure comprising a polygon, and with the cell structure including a plurality of polygons of pliable material in substantially upstanding relation to the planes of said strata, with each cell structure comprising an enclosure having fluid therein;

b. a fluid communication means being provided between adjacent cells for the transfer of fluid when the pressure on one or more cells is increased as a result of a projectile impact and for the retarded transfer of said fluid by reduction of rebound after said impact;

c. wherein the fluid communication means between the cells is controlled at a preselected rate by valving action of passages for the fluid communication, to provide a preselected rate of dampening for a preselected range of shocks.

4. The armor system according to claim 3 wherein selectively spaced and positioned cells are provided internally with a resilient material to provide further selective dampening effects when an impact load is applied to the structure.

5. The armor system according to claim 3 wherein selectively spaced and positioned cells contain a phase change material to provide temperature stabilization.

6. The armor system according to claim 5 wherein said phase change material is encapsulated.

7. A body armor system adapted to overlie the torso of a wearer and to protect the of the wearer from injury sustained as the result of projectile impact wherein impact energy is absorbed by the body armor system, and comprising in combination:

a. a wearer;

b. a projectile penetrant inhibiting layer; and c. an impact energy absorbing layer positioned proximate and in substantial overlying relation to the side of the projectile penetrant inhibiting layerclosest to the wearer and wherein said impact energy absorbing layer is adapted to spread the impact energy of the projectile substantially in the plane of the impact energy absorbing layer; and wherein said impact energy absorbing layer comprises a plurality of cells of pliable material which are in fluid communication with each other to provide a valved fluid transfer between cells;

whereby the amount of impact energy passing through the body armor is reduced so as to minimize or eliminate injury to the wearer as the result of blunt injury.

8. The body armor system according to claim 7 wherein said impact energy absorbing layer comprises:

a. a plurality of planar strata of pliable material having a plurality of cell structures bonded and sealed between the strata with each cell structure comprising a polygon, and with the cell structure including a plurality of polygons of pliable material in substantially upstanding relation to the planes of said strata, with each cell structure comprising an enclosure having fluid therein;

b. a fluid communication means being provided between adjacent cells for the transfer of fluid when the pressure on one or more cells is increased as a result of projectile impact and for the retarded transfer of said fluid by reduction of rebound after said impact;

c. wherein the fluid communication means between the cells is controlled at a preselected rate by valving action of passages for the fluid communication, to provide a preselected rate of dampening for a preselected range of shocks.

9. The body armor system according to claim 8 wherein said impact energy absorbing layer contains encapsulated phase change material to provide temperature stabilization and to thereby improve the thermal comfort of the wearer.

10. The body armor system according to claim 9 wherein said encapsulated phase change material is selected from the group consisting of paraffinic hydrocarbons and water.

11. The body armor system according to claim 10 wherein said phase change material is encapsulated.

12. The body armor system according to claim 11 wherein said encapsulated phase change material is selected from the group consisting of macrocapsules and microcapsules.

13. The body armor system according to claim 7 further including an anti-spalling layer positioned on the opposite side of said projectile penetrant inhibiting layer from said impact energy absorbing layer and wherein said anti-spalling layer is in contacting relation with said impact energy absorbing layer.

14. A body armor system adapted to overlie the torso of a wearer and to protect the torso from injury as the result of a projectile impact wherein impact energy is absorbed by the body armor system, and comprising in combination:

a. a wearer;

b. a projectile penetrant inhibiting layer;

c. an impact energy absorbing layer positioned proximate and in substantial overlying relation to the side of the projectile penetrant inhibiting layer closest to the wearer and wherein said impact energy absorbing layer is adapted to spread the impact energy of a projectile substantially in the plane of the impact energy absorbing layer wherein said impact energy absorbing layer comprises a plurality of cells of a pliable material which are in fluid communication with each other to provide a valved fluid transfer between cells; and d. an anti-spalling layer positioned on the opposite side of said projectile penetrant inhibiting layer and wherein said anti-spalling layer is in contacting relation with the impact energy absorbing layer;

whereby the amount of impact energy from a projectile passing through the armor system is reduced and injury to the wearer is minimized.

15. The body armor system according to claim 14 wherein said impact energy absorbing layer comprises a planar strata having a plurality of cells formed therein.

16. The body armor system according to claim 15 wherein said planar strata further includes a valve means for providing fluid communication between cells.

17. The body armor system according to claim 16 wherein at least some of said cells contain a foam.

18. The body armor system according to claim 17 wherein said foam contains a temperature control means.

19. The body armor system according to claim 18 wherein said temperature control means comprises an encapsulated phase change material.

* * * * *